United States Patent [19]

Raw et al.

[11] 3,984,619

[45] Oct. 5, 1976

[54] ALUMINIUM ALLOY CONDUCTOR WIRE

[75] Inventors: Peter Michael Raw, Harrow, England; Rees Jenkin Llewellyn, Burnaby, Canada

[73] Assignee: BICC Limited, London, England

[22] Filed: Jan. 27, 1975

[21] Appl. No.: 544,566

[30] Foreign Application Priority Data

Jan. 28, 1974 United Kingdom ..... 3847/74

[52] U.S. Cl. ..... 174/23 R; 75/138; 148/159; 174/128 R

[51] Int. Cl.[2] ..... H01B 1/02; H01B 7/28

[58] Field of Search ..... 75/138, 142, 147, 148; 148/2, 3, 11.5, 12.7, 159, 32, 32.5; 29/527.5, 527.7, 624, 183; 174/23 R, 23 C, 27, 128 R, 107

[56] References Cited

UNITED STATES PATENTS

| | | | |
|---|---|---|---|
| 1,695,044 | 12/1928 | Hallmann | 148/159 X |
| 2,572,562 | 10/1951 | Harrington | 75/147 |
| 3,512,221 | 5/1970 | Schoerner | 75/138 X |
| 3,571,910 | 3/1971 | Bylund | 75/138 X |
| 3,670,401 | 6/1972 | Schoerner | 75/138 X |
| 3,697,260 | 10/1972 | Hynsicker | 75/142 |
| 3,813,481 | 5/1974 | Adams | 174/128 R |
| 3,827,917 | 8/1974 | Zeigler et al. | 148/2 |
| 3,856,980 | 12/1974 | Puckowski et al. | 174/23 C |

*Primary Examiner*—Arthur T. Grimley
*Attorney, Agent, or Firm*—Eugene F. Buell

[57] ABSTRACT

An aluminium alloy conductor wire consists of between 97.25 and 99.4 (preferably 98.05 to 99.2) weight percent aluminium; between 0.3 and 1.0 (preferably 0.45 to 0.6) weight percent iron; between 0.22 and 0.7 (preferably 0.225 to 0.3) weight percent silicon, the ratio of Fe:Si being at least 4:3 and preferably at least 2:1; between 0.08 and 1.0 (preferably 0.2 to 0.5) weight percent copper; and trace quantities of conventional impurities. The conductor wire is especially suitable for use as a conductor of a telecommunication cable or as a component element of an overhead electric conductor.

15 Claims, 2 Drawing Figures

ALUMINIUM ALLOY CONDUCTOR WIRE

This invention relates to elongate members of aluminium alloy suitable for use in forming a conductor, or an element of a multi-element conductor, of an electric cable or electric insulated wire, all such elongate members hereinafter, for convenience, being included in the generic term "conductor wire".

It is an object of the present invention to provide an improved conductor wire of an aluminium alloy containing iron as a principal alloying constituent which has a higher tensile strength and higher percentage ultimate elongation than wires of known aluminium alloys which contain similar quantities of iron.

According to the invention our improved conductor wire is composed of an aluminium alloy consisting of between 97.25 and 99.4 weight percent aluminium; between 0.3 and 1.0 weight percent iron; between 0.22 and 0.7 weight percent silicon, the ratio of Fe:Si being at least 4:3; being 0.08 and 1.0 weight percent of copper; and trace quantities of conventional impurities. Preferably the Fe:Si ratio is at least 2:1.

The iron content preferably lies in the range 0.45 to 0.6 weight percent and the silicon content preferably lies in the range 0.225 to 0.3 weight percent. Preferably the copper content lies in the range 0.2 to 0.5 weight percent.

By conventional impurities is meant impurities that are normally found in aluminium in its commercially pure form either (a) as impurities not removed in the refining process, for instance vanadium, chromium, manganese, magnesium, nickel and zinc, or (b) as residues of a substance added during the refining process for the purpose of neutralising or removing some undesirable impurities, for instance titanium and boron. In normal circumstances the amount of impurities (a) present in the alloy does not exceed 0.25 weight percent and the amount of residual impurities (b) present in the alloy does not exceed 0.015 weight percent.

A conductor wire in accordance with the present invention has significantly improved tensile strength as compared with that of conductor wires of the same diameter of known aluminium alloys containing similar quantities of iron but smaller quantities of silicon and trace quantities of copper and as compared with that of conductor wires of the same diameter of an aluminium alloy containing similar quantities of iron and larger quantities of silicon than are conventionally employed, and the improved tensile properties of our conductor wire are illustrated by the following results obtained with a conductor wire of a known aluminium alloy (Alloy A) having a diameter of 0.5 mm, with a conductor wire of an aluminium alloy (Alloy B) containing iron and silicon in quantities in accordance with the present invention but containing only trace quantities of copper, and with conductor wire in accordance with the present invention (Alloys C, D, E and F) of the same diameter, as drawn and after annealing each drawn wire at several different temperatures.

TABLE I

| | Iron Content Wt % | Silicon Content Wt % | Copper Content Wt % |
|---|---|---|---|
| Alloy A | 0.50 | 0.041 | 0.002 |
| Alloy B | 0.54 | 0.29 | <0.001 |
| Alloy C | 0.55 | 0.36 | 0.22 |
| Alloy D | 0.56 | 0.29 | 0.39 |
| Alloy E | 0.55 | 0.25 | 0.58 |
| Alloy F | 0.54 | 0.36 | 0.75 |

TABLE II

| Alloy | Temperature of Annealing Treatment °C | Electrical Conductivity | 0–0.1% Proof Stress MN/m² | Tensile Strength MN/m² | Elongation % on 250 mm |
|---|---|---|---|---|---|
| A | As drawn | 61.4 | 177 | 221 | 1.6 |
| B | " | 59.7 | 197 | 261 | 2.3 |
| C | " | 57.8 | 243 | 348 | 1.4 |
| D | " | 57.2 | 251 | 365 | 1.6 |
| E | " | 56.3 | 273 | 367 | 1.5 |
| F | " | 53.9 | 303 | 409 | 1.7 |
| A | 200 | — | — | — | — |
| B | " | 62.0 | 135 | 168 | 0.7 |
| C | " | 60.5 | 165 | 211 | 0.9 |
| D | " | 59.2 | 163 | 202 | 0.7 |
| E | " | 59.4 | 180 | 214 | 0.6 |
| F | " | 58.8 | 183 | 235 | 0.8 |
| A | 225 | 62.6 | 137 | 144 | 0.4 |
| B | " | 61.9 | 117 | 146 | 0.8 |
| C | " | 60.8 | 147 | 171 | 0.7 |
| D | " | 59.6 | 144 | 171 | 1.1 |
| E | " | 59.9 | 147 | 175 | 2.5 |
| F | " | 59.2 | 150 | 187 | 3.2 |
| A | 250 | 62.3 | 104 | 121 | 5.0 |
| B | " | 62.3 | 101 | 130 | 7.3 |
| C | " | 60.9 | 109 | 151 | 9.5 |
| D | " | 60.2 | 103 | 148 | 9.5 |
| E | " | 60.0 | 118 | 159 | 10.5 |
| F | " | 59.8 | 121 | 168 | 7.5 |
| A | 262.5 | 62.4 | 96 | 116 | 14.0 |
| B | " | 62.4 | 94 | 127 | 11.0 |
| C | " | 61.0 | 98 | 143 | 10.5 |
| D | " | 60.2 | 93 | 145 | 11.5 |
| E | " | 60.0 | 97 | 151 | 11.0 |
| F | " | 59.8 | 109 | 162 | 11.5 |
| A | 275 | 62.9 | 79 | 107 | 26.0 |
| B | " | 62.5 | 83 | 122 | 15.5 |

TABLE II-continued

| Alloy | Temperature of Annealing Treatment °C | Electrical Conductivity | 0–0.1% Proof Stress MN/m² | Tensile Strength MN/m² | Elongation % on 250 mm |
|---|---|---|---|---|---|
| C | " | 61.4 | 76 | 131 | 19.0 |
| D | " | 60.2 | 70 | 137 | 15.5 |
| E | " | 59.8 | 84 | 147 | 14.5 |
| F | " | 59.5 | 99 | 159 | 11.0 |
| A | 300 | 62.9 | 50 | 103 | 31.5 |
| B | " | 62.2 | 61 | 115 | 24.5 |
| C | " | 61.1 | 73 | 132 | 19.5 |
| D | " | 59.9 | 59 | 137 | 17.0 |
| E | " | 59.5 | 62 | 140 | 16.5 |
| F | " | 59.1 | 71 | 152 | 15.0 |
| A | 350 | 63.3 | 45 | 104 | 27.0 |
| B | " | 61.3 | 50 | 118 | 22.0 |
| C | " | 60.5 | 58 | 131 | 17.0 |
| D | " | 59.0 | 56 | 134 | 18.0 |
| E | " | 58.2 | 57 | 143 | 14.0 |
| F | " | 57.0 | 63 | 152 | 14.5 |

Although in the annealed and partially annealed conditions some conductor wires of the present invention show a slight loss in electrical conductivity as compared with a conductor wire of a known aluminium alloy containing a similar quantity of iron, smaller quantities of silicon and only trace quantities of copper, the improvement in tensile strength for a given elongation renders our improved conductor wires especially suitable for use in telephone cables and in other cables where a high tensile strength is desirable and a high electrical conductivity is not of primary importance.

In some instances conductor wires of the present invention in the drawn condition, especially those of an aluminium alloy in which the iron content lies in the range 0.45 to 0.6 weight percent, the silicon content lies in the range 0.225 to 0.3 weight percent and the copper content lies in the range 0.2 to 0.5 weight percent, though having a slightly lower electrical conductivity than a conductor wire of a known aluminium alloy containing a similar quantity of iron but a smaller quantity of silicon and a trace quantity of copper and than a conductor wire of an aluminium alloy containing a similar quantity of iron and a larger quantity of silicon than is conventionally employed, have a tensile strength that is at least 50% greater than that of the drawn conductor wires of the known alloys. These drawn conductor wires of the present invention are especially suitable for use in overhead electric conductors where tensile strength is a primary consideration.

Other cables for which our improved conductor wires are suitable include cables of the kind generally known as wiring cables and used, for example, for the wiring of buildings, vehicles, aircraft, switchboards, equipment and machinery and comprising one or more conductor wires covered with insulating and/or sheathing material. Where our improved conductor wire is to be used in a wiring cable the conductor wire may have an outer cladding of copper or a copper-based alloy bonded to it, the cladding constituting the minor proportion of the cross-sectional area of the conductor wire. The provision of a copper cladding ensures that the conductor wire can be satisfactorily jointed or terminated by those methods normally employed for copper conductors.

The conductor wire of the present invention may be prepared by any of the known processes for preparing aluminium alloy wire but we prefer to prepare our improved conductor wire by continuously casting a bar of our aluminium alloy, immediately rolling the bar down to rod form, drawing the rod to the required wire size, with one or more than one intermediate anneal as required, and finally annealing the wire.

The invention also includes an electric cable or electric insulated wire comprising at least one conductor wire of the present invention, provided with at least one covering layer of insulating material, and the invention further includes an electric cable comprising two or more insulated conductors, at least one comprising at least one conductor wire of the present invention, provided with at least one covering layer of insulating material and, enclosing the insulated conductors, an outer protective sheath.

The invention further includes a telecommunication cable comprising a multiplicity of insulated conductors, each conductor comprising a conductor wire of the present invention. The condustors may be insulated with solid or cellular plastics material and the interstices between the insulated conductors and between them and a surrounding waterproof sheath from end to end of the cable length may be filled with a water-impermeable medium of a grease-like nature.

The invention still further includes an overhead electric conductor comprising a plurality of wires stranded together, at least some of which wires are conductor wires of the present invention.

The invention will be further illustrated by a description, by way of example, of a telecommunication cable and of an overhead electric conductor each incorporating conductor wires of the present invention, with reference to the accompanying drawings, in which.

Figure 1:
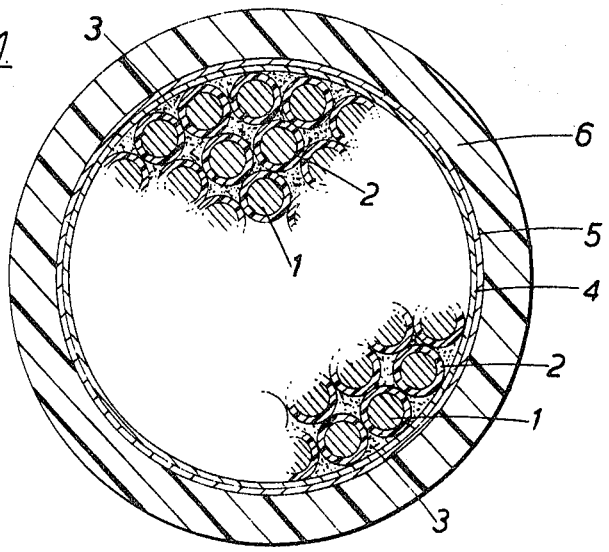
FIG. 1 is a cross-sectional end view of the telecommunication cable.
Figure 2:
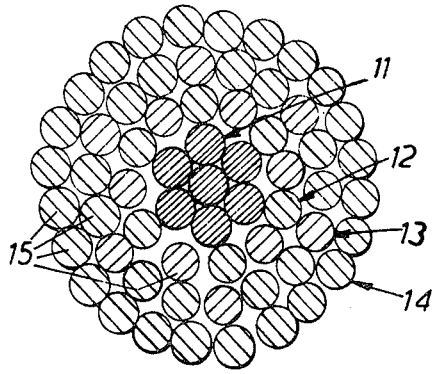
FIG. 2 is a cross-sectional end view of the overhead electric conductor.

The telecommunication cable comprises 100 pairs of insulated conductors each consisting of a partially annealed aluminium alloy wire 1 of nominal diameter 0.50 mm and an insulating covering 2 of extruded cellular polyethylene of radial thickness 0.14 mm. The aluminium alloy of each wire consists of 98.7 weight percent aluminium; 0.56 weight percent iron; 0.29 weight percent silicon; 0.39 weight percent copper; and trace quantities of conventional impurities. The wire has an electrical conductivity of 60.2 IACS, an 0.1% proof stress of 93 $MN/m^2$, a tensile strength of 145 $MN/m^2$ and elongation on 250 mm of 11.5%. The assembly of insulated conductors is surrounded by a longitudinally applied, transversely folded paper tape 4, a longitudinally applied, transversely folded aluminium tape 5 and an extruded polythene sheath 6. The interstices between the insulated conductors and between the insulated conductors and the paper tape 4 are filled with a water-impermeable medium 3 comprising highly refined petroleum jelly.

The overhead electric conductor has an overall diameter of 42.5 mm and comprises a stranded core 11 of seven steel wires, each of diameter 4.72 mm, which is surrounded by three stranded layers 12, 13 and 14 of round drawn aluminium alloy wires 15 of diameter 4.72 mm, the direction of lay of the wires of each layer being opposite to that of the wires in the or each adjacent layer. The aluminium alloy of each wire 15 consists of 98.7 weight percent aluminium; 0.56 weight percent iron; 0.29 weight percent silicon; 0.39 weight percent copper; and trace quantities of conventional impurities. Each aluminium alloy wire 15 has an electrical conductivity of 57.2 IACS, an 0.1% proof stress of 251 $MN/m^2$ a tensile strength of 365 $MN/m^2$ and elongation on 250 mm of 1.6%.

What we claim as our invention is:

1. A conductor wire composed of an aluminium alloy consisting of between 97.25 and 99.4 weight percent aluminium; between 0.3 and 1.0 weight percent iron; between 0.22 and 0.7 weight percent silicon, the ratio of Fe:Si being at least 4:3; between 0.08 and 1.0 weight percent copper; and trace quantities of conventional impurities.

2. A conductor wire composed of an aluminium alloy consisting of between 98.05 and 99.2 weight percent aluminium; between 0.45 and 0.6 weight percent iron; between 0.225 and 0.3 weight percent silicon, the ratio of Fe:Si being at least 4:3; between 0.08 and 1.0 weight percent copper; and trace quantities of conventional impurities.

3. A concuctor wire as claimed in claim 1, wherein the Fe:Si ratio is at least 2:1.

4. A conductor wire as claimed in claim 1, wherein the copper content lies in the range 0.2 to 0.5 weight percent.

5. A conductor wire as claimed in claim 1, which has at least one covering layer of insulating material.

6. A conductor wire consisting of an inner part (constituting the major proportion of the cross-sectional area of the conductor wire) composed of an aluminium alloy consisting of between 97.25 and 99.4 weight percent aluminium; between 0.3 and 1.0 weight percent iron; between 0.22 and 0.7 weight percent silicon, the ratio of Fe:Si being at least 4:3; between 0.08 and 1.0 weight percent copper; and trace quantities of conventional impurites and, bonded to the inner part, an outer part (constituting the minor proportion of the cross-sectional area of the conductor wire) of copper or a copper-based alloy.

7. A conductor wire as claimed in claim 6, which has at least one covering layer of insulating material.

8. An insulated electric conductor comprising a plurality of conductor wires each composed of an aluminum alloy consisting of between 97.25 and 99.4 weight percent aluminum, between 0.3 and 1.0 weight percent iron, between 0.22 and 0.7 weight percent silicon, the ratio of Fe:Si being at least 4:3, between 0.08 and 1.0 weight percent copper, and trace quantities of conventional impurities and, surrounding the assembly of conductor wires, at least one covering layer of insulating material.

9. An electric cable comprising at least one insulated conductor, the insulated conductor or at least one of the insulated conductors comprising at least one conductor wire composed of an aluminium alloy consisting of between 97.25 and 99.4 weight percent aluminium; between 0.3 and 1.0 weight percent iron; between 0.22 and 0.7 weight percent silicon, the ratio of Fe:Si being at least 4:3; between 0.08 and 1.0 weight percent copper; and trace quantities of conventional impurities and, surrounding the conductor wire or the conductor wires, at least one covering layer of insulating material and, enclosing the insulated conductor or insulated conductors, an outer protective sheath.

10. An electric cable comprising at least one insulated conductor, the insulated conductor or at least one of the insulated conductors comprising at least one conductor wire composed of an aluminium alloy consisting of between 98.05 and 99.2 weight percent aluminium; between 0.45 and 0.6 weight percent iron; between 0.225 and 0.3 weight percent silicon, the ratio of Fe:Si being at least 4:3; between 0.8 and 1.0 weight percent copper; and trace quantities of conventional impurities and, surrounding the conductor wire or the conductor wires, at least one covering layer of insulating material and, enclosing the insulated conductor or insulated conductors, an outer protective sheath.

11. A telecommunication cable comprising a multiplicity of insulated conductors, each conductor comprising a wire composed of an aluminium alloy consisting of between 97.25 and 99.4 weight percent aluminium; between 0.3 and 1.0 weight percent iron; between 0.22 and 0.7 weight percent silicon, the ratio of Fe:Si being at least 4:3; between 0.08 and 1.0 weight percent copper; and trace quantities of conventional impurities, and a waterproof sheath enclosing the insulated conductors.

12. A telecommunication cable comprising a multiplicity of insulated conductors, each conductor comprising a wire composed of an aluminium alloy consisting of between 97.25 and 99.4 weight percent aluminium; between 0.3 and 1.0 weight percent iron; between 0.22 and 0.7 weight percent silicon, the ratio of Fe:Si being at least 4:3; between 0.08 and 1.0 weight percent copper; and trace quantities of conventional impurities, a waterproof sheath enclosing the insulated conductors and, filling the interstices between these insulated conductors and between them and the cable sheath from end to end of the cable length, a water-impermeable medium of a grease-like nature.

13. A telecommunication cable as claimed in claim 12, wherein the insulation of each conductor is a plastics material of cellular form.

14. An overhead electric conductor comprising at least one stranded layer of wires, wherein at least some of the wires are composed of an aluminium alloy consisting of between 97.25 and 99.4 weight percent aluminium; between 0.3 and 1.0 weight percent iron; between 0.22 and 0.7 weight percent silicon, the ratio of Fe:Si being at least 4:3; between 0.08 and 1.0 weight percent copper; and trace quantities of conventional impurities.

15. An overhead electric conductor comprising a core of at least one metallic element of high tensile strength and, surrounding the core, at least one stranded layer of wires each composed of an aluminium alloy consisting of between 97.25 and 99.4 weight percent aluminium; between 0.3 and 1.0 weight percent iron; between 0.22 and 0.7 weight percent silicon, the ratio of Fe:Si being at least 4:3; between 0.08 and 1.0 weight percent copper; and trace quantities of conventional impurities.

* * * * *